US005836483A

United States Patent [19]

Disel

[11] Patent Number: 5,836,483

[45] Date of Patent: Nov. 17, 1998

[54] SELF-REGULATING FLUID DISPENSING CAP WITH SAFETY PRESSURE RELIEF VALVE FOR DENTAL/MEDICAL UNIT FLUID BOTTLES

[75] Inventor: Jimmy D. Disel, San Jose, Calif.

[73] Assignee: Aerotech Dental Systems, Inc., San Jose, Calif.

[21] Appl. No.: 795,218

[22] Filed: Feb. 5, 1997

[51] Int. Cl.[6] ..... B65D 83/14

[52] U.S. Cl. ..... 222/396; 222/400.7; 137/212

[58] Field of Search ..... 222/396, 397, 222/400.7; 137/212

[56] References Cited

U.S. PATENT DOCUMENTS 3,090,530 5/1963 Peeps ..... 222/400.7
3,759,291 9/1973 Moore et al. ..... 222/400.7
4,993,599 2/1991 Gruenewald ..... 222/400.7
5,199,603 4/1993 Prescott ..... 222/400.7

*Primary Examiner*—Philippe Derakshani
*Attorney, Agent, or Firm*—Jacques M. Dulin; Heller, Ehrman, White & McAuliffe

[57] ABSTRACT

Unitary, self-regulating fluid dispensing cap for a dental unit water line treatment system having both a regulator valve and a relief valve located therein, and threads to receive a fluid bottle. The cap receives unregulated high pressure air of 50–80 psi and controls and reduces the pressure to about 30–35 psi with the adjustable regulator valve. The relief valve prevents the fluid bottle from bursting if over pressure of above about 35 psi, or other selected value, builds up in the bottle.

10 Claims, 2 Drawing Sheets

SELF-REGULATING FLUID DISPENSING CAP WITH SAFETY PRESSURE RELIEF VALVE FOR DENTAL/MEDICAL UNIT FLUID BOTTLES

DESCRIPTION

1. Technical Field

This invention relates to a fluid dispensing cap having a regulator valve and a safety pressure relief value integrated therein particularly useful in connection with fluid bottles for dental units, and more particularly for medical grade water bottles and for dental unit water line disinfectant solution bottles used with dental units.

2. Background of the Prior Art

There is a current very serious concern regarding the contamination of dental unit water lines (DUWL) with microbial slime. The background on this is set forth in my copending applications Ser. No. 08/409,739 filed Apr. 10, 1995, entitled ANTI-MICROBAL FLUSH SYSTEM: Ser. No. PCT/US96/03969 filed Mar. 22, 1996, same title; Ser. No. 08/757,010 filed Nov. 26, 1996 (file 5478-002-32 PWC), same title; and Ser. No. 60/032,313 filed Nov. 30, 1996 (File 5478-010-32 PROV) for IMPROVED SINGLE LINE AUTOMATIC FLUID DELIVERY SYSTEM FOR DENTAL UNIT WATER LINE TREATMENT; the disclosures of which are incorporated herewith by reference for further background.

Currently, these fluid dispensing systems, being either manual or automated, employ one or more bottles in the system. In a two-bottle system, the first bottle is for active dental handpiece use for cooling or for syringe use for rinsing the patient mouth and gums. The second bottle contains a disinfectant solution for disinfecting the water lines. Disinfecting water lines has become essential to good dental hygienic practices because the water lines remain stagnant between patient procedures, overnight, and over the weekend. Use of city water rapidly results in the proliferation of bacterial slime which is a complex of bacteria, amoebas and other microorganisms. This slime includes something over 17 varieties of Legionella bacteria and has led to approximately 7 deaths of dental professionals from aspirated water droplets, and innumerable colds and bacterial infections of the patients.

Accordingly, a number of companies have developed DUWL treatment systems. For example, AMPCO-Rembrandt offers a manual, two-bottle system under Model No.BCS-4 AND HIGHLANDER OFFERS A MANUAL 1-BOTTLE SYSTEM UNDER MODEL BCS-1. In contrast, Aerotech Dental (in San Jose, Calif.) offers a completely automated two-bottle system, Model AFDS 2000. In the AMPCO system, a simple cap with a dip tube for outlet of the water or the disinfectant solution, and an air pressure inlet is provided. Up or downstream thereof, as the case may be, are various valves for control of the water and air pressure. It is a serious disadvantage to have the valving separate from the cap because the intervening space which in the AMPCO system is not disinfected can permit propagation of the microbial slime. In addition, over pressure in the bottles can cause the bottles to explode or crack thus leading to serious malfunctions in the system.

DISCLOSURE OF INVENTION

Accordingly, it is an object and advantage of this invention to provide a universal cap for both manual and automated systems which incorporates control valving, and also includes a relief valve to prevent bottle rupture from over pressure being developed in the bottle.

The invention comprises a unitary cap having both a regulator valve and a safety valve incorporated therein for controlling the air pressure into the DUWL treatment system fluid bottles, as well as the outlet of the fluid, and providing a safety relief valve. The cap comprises a cylindrical member having a longitudinal axis and a top end and a bottom end. Formed in the bottom end of the cap are threads to matingly engage the threaded top of the DUWL treatment system fluid bottle. In addition, a bore for a fluid delivery tube is provided parallel to the longitudinal axis of the cylindrical cap member. This terminates at the lower end in a recessed shoulder or a hollow barb which receives the dip tube which projects down into the bottle. A first side of the bottle cap has a transverse bore therein which receives the air pressure inlet, which intersects a large bore for air pressure regulator valve which is inserted therein. This bore commences, conveniently, at the top of the cylindrical member and continues partly through the cap to intersect with the air pressure inlet bore, but does not pass completely through the cap. Optionally, this bore can pass completely through the cap from top to bottom or to bottom recess and can be plugged at both top and bottom ends after the regular valve is inserted therein. The regulator valve comprises a spool having appropriate O-ring seals thereon and is double biased by a first main pressure spring and a second adjustment spring. The pressure adjustment spring is located on the top of the value and is accessible at the top of the cap by means of a set screw to carefully control the pressure delivered to the bottle. Air, after passing through the regulator valve enters the bottle to pressurize the fluid in the bottle. When pressurized, the fluid is pushed up the dip tube and out the top of the cap to the fluid delivery line projecting through the axially parallel bore. Optionally, and preferably, a second transverse bore is provided in the air path downstream of the pressure regulator valve to permit mounting of a safety valve in communication therewith. The safety relief valve is located in an axially parallel bore in fluid (air) pressure communication with the outlet from the pressure regulator valve and the bottle. The safety valve triggers and relieves pressure in the bottle when it exceeds a preset maximum. For example, where the inlet pressure is some 60–90 psi, the regulator valve controls it to approximately 30–35 psi. The safety valve can be regulated to blow at 40–45 psi before the bottle, typically plastic, ruptures.

BRIEF DESCRIPTION OF DRAWINGS

The invention is illustrated in connection with the accompanying drawings in which.

BEST MODE FOR CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
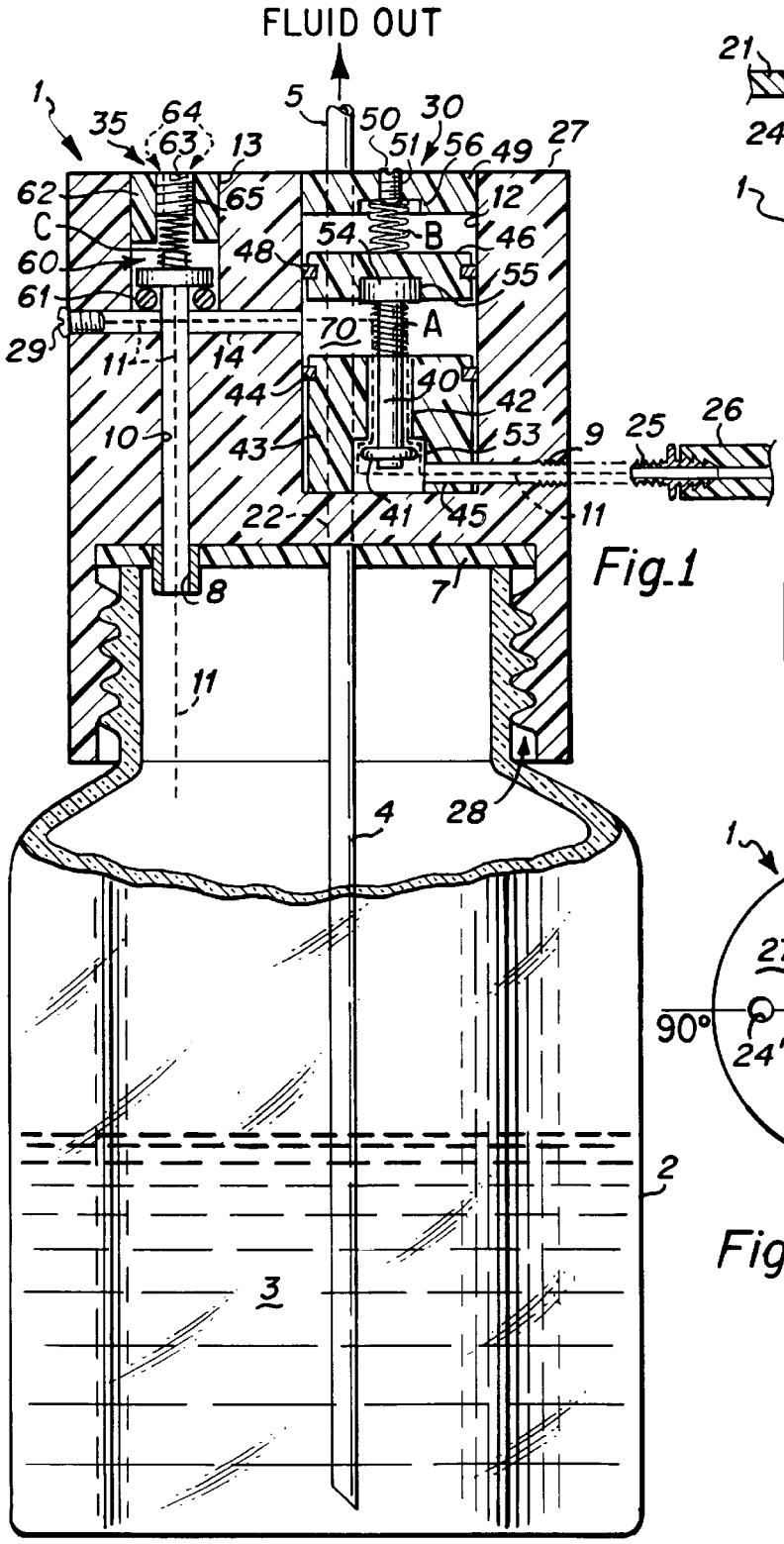
FIG. 1 is a side elevation view, in section, through the self-regulating fluid dispensing cap having a relief valve of the invention, assembled on the fluid bottle.
Figure 2:
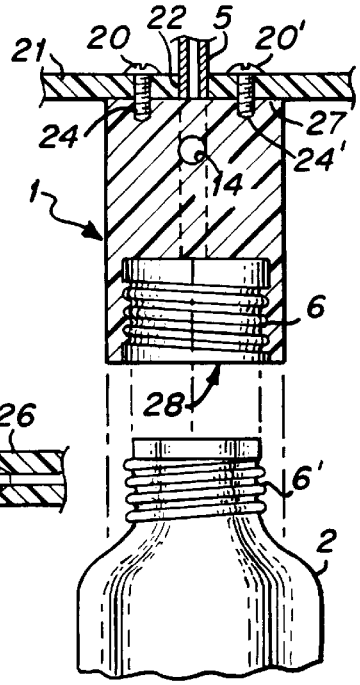
FIG. 2 shows an exploded view, the bottle in perspective and the cap partly in section.

FIG. 1 illustrates in side elevation view the cap of the invention assembled on the fluid bottle and FIG. 2 shows the bottle unscrewed from the cap which is mounted by screws 20, 20' through mounting plate 21 which includes an aperture 22 for the outlet tube 5. Bottle 2 contains fluid 3, e.g., water or disinfectant, which is delivered by air pressure up dip tube 4 to outlet 5, via bore 22 through the cap. The outlet 5 connects to a manual or automated fluid delivery system (not shown), e.g., an Ampco-Rembrandt ModelBCS-4 or Highlander BCS-1 (both manual) or an Aerotech Dental Systems AFDS 2000 automatic system (Aerotech, San Jose, Calif.).

The bottle 2 is engaged to cap 1 by any convenient means, mating threads 6 being shown, but a bayonet mount may also be used. The cap is sealed to the bottle by diaphragm gasket 7 which includes an aperture for tube 4 and an aperture 8 for the air inlet 10. Alternately, the gasket can be a ring gasket, for which no special apertures are needed.

The cap 1 is generally cylindrical, and includes a recess 28 at one end for the threads 6, two valve bores 12 and 13, and bottle air inlet bore 10, all parallel to the central axis. The bore 22 of outlet tube 5 is also parallel to the central axis. The regulator valve bore 12 communicates adjacent to its bottom with transverse air inlet bore 9. Approximately halfway up the side of bore 12 is a transverse bore 14 which communicates with both through bore 10 and relief valve bore 13. The intersection of these bores 10, 13 and 14 occurs where larger bore 13 forms a shoulder with bore 10.

In operation, following air path 11, air from a source (not shown) at, typically, from 50/80 psi, is introduced into bore 9. Preferably, a standard hollow barb-type connect 25 is threaded or press fit into bore 9 to receive air supply tube 26 from an external compressor. The high pressure air passes through regulator valve 30 where the pressure is regulated down to 30–35 psi. It then passes through cross bore 14, and thence down bore 10 to pressurize the headspace 23 above the liquid with air at about 30–35 psi. The cross bore is sealed by set screw or plug 29. If the pressure gets too high, say about 40–45 psi, the relief (safety) valve 35 releases, and reduces the pressure to ~35 psi to prevent the bottle, typically plastic from splitting open or forcing fluid out outlet tube 5 under too much pressure for the dental unit water line delivery system.

Figures 3A, 3B:
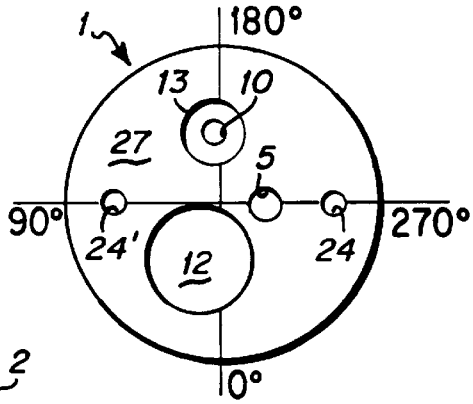
FIG. 3A shows a top plan view of the cap top with orientation angles for the various vertical hole borings for the valves and fluid passages.
FIG. 3B shows a top plan view of the cap top with dimensional relationships.
Figure 4:
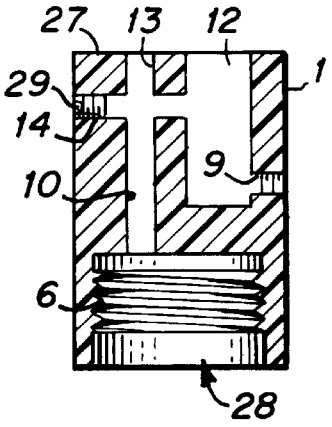
FIG. 4 is a side section view showing the completed vertical bores and the cross bores for air flow.

FIGS. 3A and 3B show the top of the cap 27 and the identification, size and location of the various boreholes 10, 12, 13. In addition, mounting screw holes 24, 24' are shown. FIG. 4 shows the cap in side elevation section view with location of the boreholes 10, 12, 13 and transverse holes 9 and 14 as well as thread recess 28.

Figure 5A:
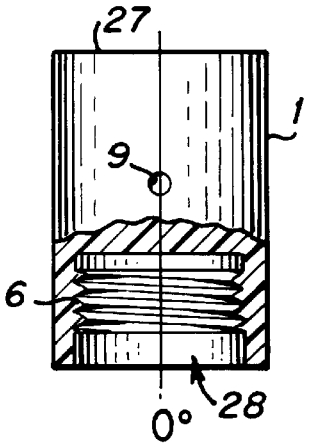
FIG. 5A is a side elevation view showing the dimensional location from the 0° position (shown in FIG. 3A) of the air inlet bore.
Figure 5B:
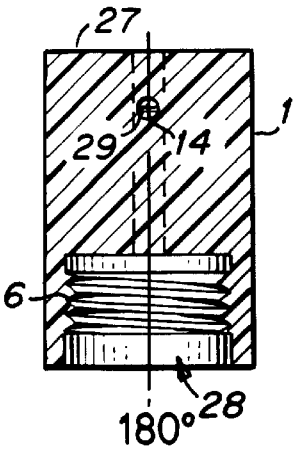
FIG. 5B is a side elevation view showing the dimensional location from the 180° position (shown in FIG. 3A) of the cross bore connecting the regulator and the relief valve vertical bores.

FIGS. 5A and 5B are side elevations from the 0° and 180° positions (see FIG. 3A for orientation), respectively showing placement of the air inlet bore 9 and cross bore 14.

Figure 6:
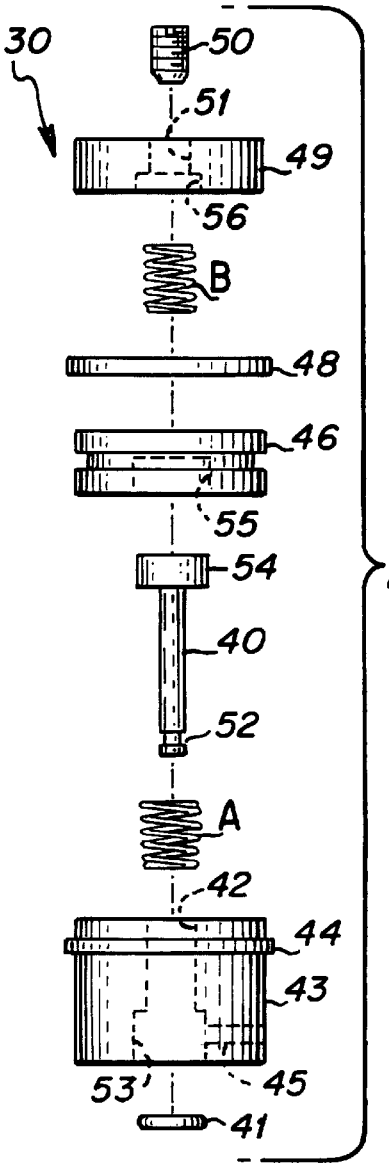
FIG. 6 is an exploded view of the regulator valve spool assembly.
Figure 7:
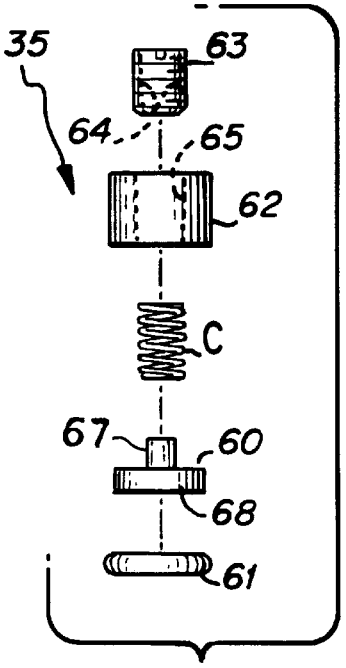
FIG. 7 is an exploded view of the relief valve spool assembly.

The valve parts are shown in FIGS. 6 and 7 in exploded relationship, and assembled in FIG. 1. Looking at FIGS. 6 and 1 the regulator valve 30 comprises a valve stem 40 which fits in hole 42 in valve body 43. The valve body 43 includes a transverse hole 45 which aligns with air inlet bore 9. The bore 42 opens into a larger counter bore 53. The stem 40 projects into the counter bore 53 through the bore 42, which is larger than stem 40, and is sealed by O-ring 41 mounted on groove 52 in stem 40. Compression spring A is mounted on stem 40 before it is inserted in hole 42. Its bottom seats against top of the valve body 43 and pushes up against underside of head 54 at the top end of stem 40. This head 54 fits in a counter bore 55 (FIG. 1) of the piston 46. The valve body is sealed in bore 12 by quad ring 44 that fits in a corresponding groove 44', while the piston seals in bore 13 by quad ring 48. The piston is pressed down by spring B, the pressure tension of which is adjusted by setscrew 50 threaded in hole 51 in cap 49, which cap is press fit in bore 13. The spring B is stronger than spring A so that the piston 46 pushes down on head 54, opening a passage for the 50–80 psi air. When the pressure in space 70 reaches about 35 psi, the combination of the upward pressure on the bottom of the piston 46 plus the spring A upward force closes the bore 42 by means of O-ring 41. Counter bore 56 in cap 49 captures spring B. This controls pressure at about 35 psi in space 70, cross bore 14, bore 10 and bottle headspace 23.

The relief valve 35 fits in bore 13 and comprises a valve stem 60 comprising a capture stem 67 and a foot 68, the spring C is mounted on the stem 67 and the foot seals on the O-ring 61 seated in the bottom of bore 13. The spring fits in bore 65 in cap 62 which his threaded at its top end to receive grooved set screw 63. The cap is press fit in bore 13. When an overpressure situation arises, the pressure on bottom of foot 68 presses against spring force, and air escapes past O-ring 61 and out grooves 64 in screw 63. The mounting plate 21 (FIG. 2) preferably has a hole (not shown) that lines up with the overpressure screw 63. The screw 63 can be adjusted in or out to control the pressure at which the relief valve releases. The relief valve can be located in a bore coaxial with cross bore 14 if desired, and bore 13 eliminated.

Industrial Applicability

The self-regulating pressure cap of this invention has wide industrial applicability, not only for delivery by air pressure of water and/or disinfectant solution, but for all pressure-delivered fluids, such as chemicals, food syrups in soda fountain dispensing systems, and beverage dispensers, including liquor and mixers in bars. The pressure does not need to t be air. It can be $CO_2$ or an inert gas such as nitrogen.

The valving system, being integrated in the cap, makes for foolproof use in a dispensing system. The pressure gas tube is pushed onto the side barb 25 of the cap and the cap outlet delivery tube 5 is connected to the delivery line of the subject dispensing system.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A cap for a water line treatment system comprising in operative combination:

(a) a generally cylindrical cap body having a recess in one end and threads in said recess for receiving engaging a fluid bottle for supply of fluid to said water line;

(b) said cap including a regulator valve and a relief valve disposed in bores therein;

(c) said cap including a high pressure air inlet bore to said regulator valve and a low pressure bore leading from said regulator valve into communication with a head-space volume in said bottle; and (d) said relief valve is located in said cap in communication with said low pressure bore, said relief valve includes means for preventing overpressure build-up in said bottle.

2. A cap as in claim 1 wherein said regulator valve includes means to adjust pressure passed therethrough.

3. A cap as in claim 1 wherein said relief valve is adjustable.

4. A cap as in claim 2 wherein said relief valve is adjustable.

5. A cap as in claim 2 wherein said cap includes means to mount it on a mounting plate.

6. A cap as in claim 1 wherein said cap includes a dip tube and fluid outlet passage for delivery of fluid retained in said bottle.

7. A cap as in claim 1 wherein said regulator regulates inlet air pressure from below about 100 psi to about 30–35 psi.

8. A cap as in claim 1 wherein said relief valve relieves pressure when pressure in said bottle exceeds from about 35–45 psi.

9. A cap as in claim 1 wherein said water line is in a dental unit water line system.

10. A cap as in claim 2 wherein said dental unit water line system is either a one or two bottle manual system or a 2 bottle automated system.

* * * * *